US007986082B2

(12) United States Patent
Manabe et al.

(10) Patent No.: US 7,986,082 B2
(45) Date of Patent: Jul. 26, 2011

(54) FLUORESCENT LAMP WITH GLASS TUBE AND PROTECTIVE LAYER, METHOD FOR PRODUCING THE SAME, AND LIGHTING SYSTEM

(75) Inventors: Yoshio Manabe, Osaka (JP); Fumihiro Inagaki, Kyoto (JP); Shogo Toda, Osaka (JP); Masaaki Hama, Kyoto (JP)

(73) Assignee: Panasonic Corporation, Osaka (JP)

( * ) Notice: Subject to any disclaimer, the term of this patent is extended or adjusted under 35 U.S.C. 154(b) by 498 days.

(21) Appl. No.: 11/914,635

(22) PCT Filed: May 29, 2006

(86) PCT No.: PCT/JP2006/310643

§ 371 (c)(1),
(2), (4) Date: Nov. 16, 2007

(87) PCT Pub. No.: WO2006/129590

PCT Pub. Date: Dec. 7, 2006

(65) Prior Publication Data

US 2009/0079325 A1 Mar. 26, 2009

(30) Foreign Application Priority Data

May 31, 2005 (JP) ..... 2005-160008

(51) Int. Cl.
*H01J 1/62* (2006.01)

(52) U.S. Cl. ..... 313/489; 445/24; 313/506

(58) Field of Classification Search ..... 313/489, 313/506; 445/24

See application file for complete search history.

(56) References Cited

U.S. PATENT DOCUMENTS

| | | | | |
|---|---|---|---|---|
| 3,624,444 | A * | 11/1971 | Berthold et al. | 313/161 |
| 3,780,330 | A * | 12/1973 | Otsuka et al. | 313/484 |
| 5,008,789 | A | 4/1991 | Arai et al. | |
| 5,051,650 | A | 9/1991 | Taya et al. | |
| 5,552,665 | A * | 9/1996 | Trushell | 313/489 |
| 6,281,625 | B1 | 8/2001 | Tachibana et al. | |
| 6,380,265 | B1 | 4/2002 | Pryor et al. | |
| 6,472,812 | B2 * | 10/2002 | Vose et al. | 313/486 |
| 6,531,823 | B2 * | 3/2003 | Vose et al. | 313/639 |
| 6,579,606 | B1 * | 6/2003 | Uchiya et al. | 428/323 |
| 2005/0285537 | A1 * | 12/2005 | Inagaki et al. | 313/635 |
| 2007/0103050 | A1 * | 5/2007 | Jansma | 313/489 |

FOREIGN PATENT DOCUMENTS

| | | |
|---|---|---|
| CN | 1236182 | 11/1999 |
| CN | 1323277 | 11/2001 |
| JP | 57-084560 | 5/1982 |
| JP | 2-216751 | 8/1990 |

(Continued)

*Primary Examiner* — Peter Macchiarolo

(74) *Attorney, Agent, or Firm* — Hamre, Schumann, Mueller & Larson, P.C.

(57) ABSTRACT

A fluorescent lamp according to the present invention includes: a glass tube 1 in which mercury and a rare gas are enclosed; a protective film 3 that is attached so as to cover an inner face of the glass tube 1; and a phosphor layer 4 that is laminated on the protective film 3. The protective film 3 has a thickness of 0.5 μm to 3 μm. Further, the protective film 3 is formed of inorganic particles and has a volume ratio of 0.1 to 0.5. Preferably, the inorganic particles are of at least one selected from the group consisting of aluminum oxide, silicon dioxide, magnesium oxide, zinc oxide, titanium oxide, cerium oxide, yttrium oxide, and calcium halophosphate.

12 Claims, 6 Drawing Sheets

FOREIGN PATENT DOCUMENTS

| | | | |
|---|---|---|---|
| JP | 2-223147 | | 9/1990 |
| JP | 5-101808 | | 4/1993 |
| JP | 6-013041 | | 1/1994 |
| JP | 7-138499 | | 5/1995 |
| JP | 07254390 A | * | 10/1995 |
| JP | 8-329893 | | 12/1996 |
| JP | 9-153345 | | 6/1997 |
| JP | 9-245734 | | 9/1997 |
| JP | 11-339722 | | 12/1999 |
| JP | 2000-113857 | | 4/2000 |
| JP | 2001-15017 | | 1/2001 |
| JP | 2003-51284 | | 2/2003 |

* cited by examiner

FLUORESCENT LAMP WITH GLASS TUBE AND PROTECTIVE LAYER, METHOD FOR PRODUCING THE SAME, AND LIGHTING SYSTEM

TECHNICAL FIELD

The present invention relates to a fluorescent lamp, a method of manufacturing the same, and an illuminator using the fluorescent lamp.

BACKGROUND ART

Recent years have seen the widespread use of fluorescent lamps for providing illumination in offices as well as in ordinary households. Fluorescent lamps in general use have a configuration in which a phosphor layer is formed on an inner face of a glass tube, and mercury and a rare gas are enclosed inside the glass tube. Further, at each end of the glass tube, an electrode is located and used to cause an electric discharge in the glass tube, which causes ultraviolet light to be generated from the mercury, and using this ultraviolet light, the phosphor layer generates visible light that then is emitted from the glass tube to the exterior.

Though characterized by its superior luminous efficiency and low power consumption as compared with an incandescent lamp, such a fluorescent lamp presents a problem in that, after a long period of use, sodium (Na) contained in the glass of a glass tube is diffused and forms an amalgam with mercury in the glass tube, so that the mercury is consumed, resulting in a decrease in luminous flux maintenance factor. In order to solve this problem, conventionally, a configuration has been proposed in which, for example, a protective film made up of inorganic particles is formed between a glass tube and a phosphor layer (see, for example, Patent Documents 1 and 2). Further, such a protective film also has the effect of reflecting ultraviolet light generated in a glass tube, thereby preventing the emission of the ultraviolet light to the exterior and increasing the utilization efficiency of the ultraviolet light to improve the luminous flux of a fluorescent lamp.

That is, Patent Document 1 proposes a fluorescent lamp including: a glass tube that is filled with mercury and an enclosed gas including a rare gas; a protective film that is made up primarily of alumina including boehmite type alumina and γ-alumina and is formed on an inner wall face of the glass tube; a phosphor layer that contains phosphor particles and is provided on this protective film; and a unit for maintaining an electric discharge in the enclosed gas.

Furthermore, Patent Document 2 proposes a fluorescent lamp including: a glass bulb; an electrode unit that is provided so as to be enclosed inside this bulb; an electric discharge maintaining medium that is enclosed in this bulb; a metal oxide film that is made up primarily of yttrium oxide whose primary particles are spherical or substantially spherical and have a diameter of 40 to 75 nm as a median value, and is formed as a mixture thereof with aluminum oxide; and a phosphor film that is formed so as to be laminated on this metal oxide film.

Patent Document 1: JP 2001-15017 A

Patent Document 2: JP 2003-51284 A

With a protective film provided between a glass tube and a phosphor layer as described above, it is possible to suppress the consumption of mercury in the glass tube and improve the utilization factor of ultraviolet light. This effect of the protective film increases with increasing thickness of the protective film. However, according to the conventional technique, such a protective film is set to have a thickness of about 0.1 μm or a thickness of at most about 0.2 μm. This is because, in a heating process for manufacturing a fluorescent lamp, a protective film having a thickness of more than 0.2 μm may peel off a glass tube due to a difference in expansion coefficient between the glass tube and the protective film. Particularly, when a protective film and a phosphor layer are formed in a straight glass tube, and then the glass tube is processed into the shape of a circular tube by heating, it has been the case that the protective film is likely to peel off at a bent portion of the glass tube. The peeling of a protective film may cause a phosphor layer to peel off as well, so that the luminous flux is lowered, resulting in a deterioration in the quality of a fluorescent lamp.

DISCLOSURE OF INVENTION

In order to solve the above-described problem, the present invention provides a fluorescent lamp in which peeling of a protective film does not occur even when the protective film is set to have a large thickness of more than 0.2 μm, a method of manufacturing the same, and an illuminator using the fluorescent lamp.

A fluorescent lamp according to the present invention includes: a glass tube in which mercury and a rare gas are enclosed; a protective film that is attached so as to cover an inner face of the glass tube; and a phosphor layer that is laminated on the protective film. In the fluorescent lamp, the protective film has a thickness of 0.5 μm to 3 μm. Further, the protective film is formed of inorganic particles and has a volume ratio of 0.1 to 0.5.

Furthermore, an illuminator according to the present invention includes the above-described fluorescent lamp according to the present invention.

Furthermore, a first method of manufacturing a fluorescent lamp according to the present invention includes process steps of: preparing a protective film liquid by dispersing inorganic particles having a mean particle diameter of 20 nm to 200 nm in water that has been adjusted to have a pH varying by 3 or more from an isoelectric point of the inorganic particles; applying the protective film liquid to an inner face of a glass tube; and drying the protective film liquid applied to the glass tube so that a protective film is formed on a surface of the glass tube.

Furthermore, a second method of manufacturing a fluorescent lamp according to the present invention includes process steps of: preparing a protective film liquid by dispersing inorganic particles having a mean particle diameter of 20 nm to 200 nm in an organic solvent containing an organic filler; applying the protective film liquid to an inner face of a glass tube; drying the protective film liquid applied to the glass tube so that a protective film is formed on a surface of the glass tube; and removing the organic filler by heating the protective film.

The fluorescent lamp according to the present invention can suppress the consumption of mercury in a glass tube to improve a luminous flux maintenance factor and can increase the utilization factor of ultraviolet light to improve the luminous flux. Further, the method of manufacturing a fluorescent lamp according to the present invention allows a fluorescent lamp in which the volume ratio of a protective film is controlled to be manufactured by a simple method. Moreover, the illuminator according to the present invention includes the fluorescent lamp according to the present invention and thus can provide a high-quality illuminator that achieves improvements in characteristics such as luminous flux and a luminous flux maintenance factor.

DESCRIPTION OF THE INVENTION

Figure 1:
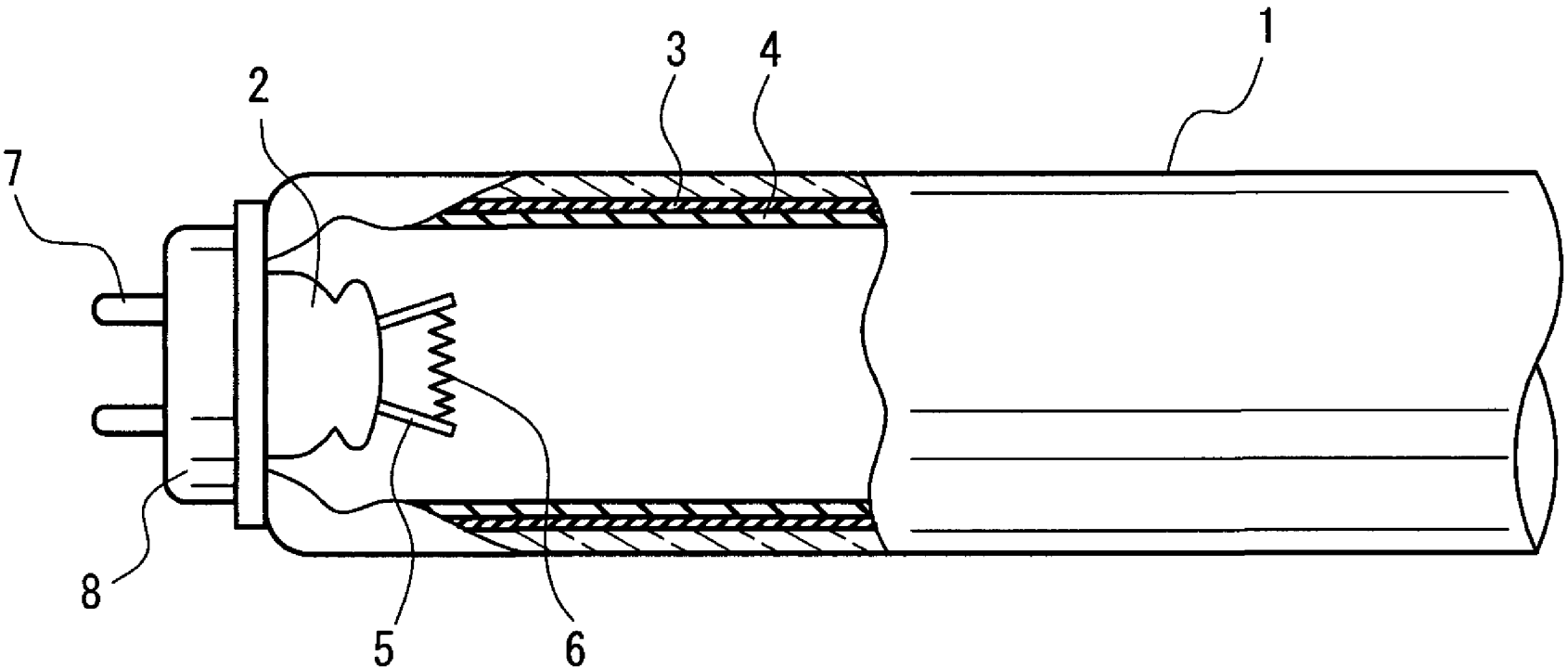
FIG. 1 is a partially cut-away view showing an example of a fluorescent lamp according to the present invention.

The fluorescent lamp according to the present invention is a fluorescent lamp including: a glass tube in which mercury and a rare gas are enclosed; a protective film that is attached so as to cover an inner face of the glass tube; and a phosphor layer that is laminated on the protective film.

Furthermore, the above-described protective film has a thickness of 0.5 μm to 3 μm. Thus, it is possible to suppress the consumption of mercury in the glass tube and improve the utilization factor of ultraviolet light. In the case of a protective film having a thickness of less than 0.5 μm, the effect of suppressing the consumption of mercury in a glass tube is limited, so that a luminous flux maintenance factor is decreased, and the utilization factor of ultraviolet light also is decreased to lower luminous flux. Further, in the case of a protective film having a thickness of more than 3 μm, peeling of the protective film occurs. A more preferred range of the thickness of the protective film is 1 μm to 2 μm.

Furthermore, the above-described protective film is formed of inorganic particles and has a volume ratio of 0.1 to 0.5. Thus, it is possible to suppress peeling of a protective film even when the protective film is set to have a thickness of 0.5 to 3 μm. In the case of a protective film having a volume ratio of less than 0.1, the strength of the protective film is decreased, thus hampering the formation of the protective film. In the case of a protective film having a volume ratio of more than 0.5, peeling of the protective film occurs. A more preferable range of the volume ratio of the protective film is 0.2 to 0.4.

In the present invention, with respect to a protective film formed on an inner face of a glass tube, a volume ratio is defined to be a quotient of a mass per unit volume of the protective film divided by a particle density of inorganic particles constituting the protective film. A particle density refers to a mass per unit volume of particles determined where the volume includes a closed cavity present inside a particle and excludes a cavity open to the outside of a particle. Further, in this specification, it is assumed that a particle density is determined by a constant volume compression method.

It is preferable that the inorganic particles constituting the protective film are of at least one selected from the group consisting of aluminum oxide ($Al_2O_3$), silicon dioxide ($SiO_2$), magnesium oxide (MgO), zinc oxide (ZnO), titanium oxide ($TiO_2$), cerium oxide ($CeO_2$), yttrium oxide ($Y_2O_3$), and calcium halophosphate, and most preferred among these are aluminum oxide and silicon dioxide for the following reasons. That is, aluminum oxide and silicon dioxide are both thermally stable, and in addition, silicon dioxide exhibits the highest reflectance with respect to ultraviolet light and thus can achieve the highest utilization factor of ultraviolet light. Further, it is preferable that the inorganic particles have a mean particle diameter of 20 nm to 200 nm. This is because, with this range of a mean particle diameter of the inorganic particles, the volume ratio of the protective film rationally can be controlled so as to be in the range of 0.1 to 0.5.

As the above-described glass tube, a straight glass tube or a circular glass tube can be used, and a glass tube of another shape also can be used.

Furthermore, the illuminator according to the present invention is an illuminator including the above-described fluorescent lamp according to the present invention. The florescent lamp according to the present invention is included, and thus an illuminator that achieves improvements in luminous flux maintenance factor and in luminous flux can be provided. Examples of an illuminator include an indoor/outdoor illumination lamp, a vehicle interior illumination lamp, an emergency lamp, and a decorative lamp.

Furthermore, the first method of manufacturing a fluorescent lamp according to the present invention includes process steps of: preparing a protective film liquid by dispersing inorganic particles having a mean particle diameter of 20 nm to 200 nm in water that has been adjusted to have a pH varying by 3 or more from an isoelectric point of the inorganic particles; applying the protective film liquid to an inner face of a glass tube; and drying the protective film liquid applied to the glass tube so that a protective film is formed on a surface of the glass tube. Inorganic particles having a mean particle diameter in a specific range are dispersed in water whose pH has been adjusted to be in a specific range, and thus the dispersibility of the inorganic particles can be increased to achieve a decrease in volume ratio of a protective film.

Herein, an isoelectric point of inorganic particles refers to a pH value at which an electric charge amount of the inorganic particles as a whole after being ionized has a mean value of 0. In this specification, it is assumed that an isoelectric point of inorganic particles is measured by "Method of Measuring Isoelectric Point of Fine Ceramic Powder" stipulated in the Japanese Industrial Standard (JIS) R1638. Further, in this specification, it is assumed that a mean particle diameter is measured by the ultrasonic attenuation spectroscopy.

To be more specific, in the case of using aluminum oxide particles (isoelectric point: 7.4 to 8.6) as the above-described inorganic particles, the pH is adjusted to 4 to 5.5, and thus a protective film having a volume ratio of 0.1 to 0.5 can be obtained. Further, in the case of using silicon dioxide particles (isoelectric point: 1.8 to 2.5) as the above-described inorganic particles, the pH is adjusted to 8 to 10, and thus a protective film having a volume ratio of 0.1 to 0.5 can be obtained.

Furthermore, the second method of manufacturing a fluorescent lamp according to the present invention includes process steps of: preparing a protective film liquid by dispersing inorganic particles having a mean particle diameter of 20 nm to 200 nm in an organic solvent containing an organic filler; applying the protective film liquid to an inner face of a glass tube; drying the protective film liquid applied to the glass tube so that a protective film is formed on a surface of the glass tube; and removing the organic filler by heating the protective film. Inorganic particles having a mean particle diameter in a specific range are dispersed in an organic solvent containing an organic filler, and thus the dispersibility of the inorganic particles can be increased to achieve a decrease in volume ratio of a protective film.

The content of the above-described organic filler can be set to 1 wt % to 10 wt % with respect to a total weight of the organic solvent and the organic filler.

Hereinafter, the present invention will be described by way of embodiments with reference to the appended drawings.

EMBODIMENT 1

The description is directed first to an embodiment of the fluorescent lamp according to the present invention by referring to the appended drawings. FIG. 1 is a partially cut-away view showing an example of the fluorescent lamp according to the present invention. In FIG. 1, a straight glass tube 1 is sealed at each end by a stem 2, and mercury and a rare gas such as neon (Ne), argon (Ar) or krypton (Kr) are enclosed in the glass tube 1. A protective film 3 having a thickness of 0.5 to 3 μm and a volume ratio of 0.1 to 0.5 is attached so as to cover an inner face of the glass tube 1. Further, a phosphor layer 4 containing a phosphor is laminated on the protective film 3. The phosphor layer 4 generally has a thickness of 15 to 25 μm. A filament electrode 6 is mounted to the stem 2 using two lead wires 5. A base 8 with an electrode terminal 7 is bonded to each end of the glass tube 1, and the electrode terminal 7 is connected to the lead wires 5.

In the fluorescent lamp of this embodiment, the protective film 3 having a thickness of 0.5 to 3 μm is attached so as to cover the inner face of the glass tube. This suppresses the consumption of the mercury in the glass tube 1 to improve a luminous flux maintenance factor, and increases the utilization factor of ultraviolet light to improve luminous flux. Further, the protective film 3 is set to have a volume ratio of 0.1 to 0.5, and thus peeling of the protective film 3 also is prevented.

There is no particular limitation on a method of forming the protective film 3, and for example, the following method could be adopted. That is, a protective film liquid in which inorganic particles are dispersed uniformly in water is prepared, and then is applied to an inner face of a glass tube and dried. There also is no particular limitation on methods of applying the protective film liquid and drying it, and for example, the following methods could be adopted. That is, from an upper portion of the glass tube in an upright state, the protective film liquid is allowed to flow down spontaneously so as to be applied, and then drying is performed by passing warm air through the glass tube. The thickness of the protection film 3 can be controlled through adjusting an amount of the protective film liquid to be applied. Further, the volume ratio can be controlled so as to be 0.1 to 0.5 by a method in which the pH of the protective film liquid and the mean particle diameter of the inorganic particles in the protective film liquid are controlled so as to be in specific ranges, respectively. This control of a volume ratio will be described more specifically in Embodiment 2.

There is no particular limitation on a method of forming the phosphor layer 4, and for example, the following method could be adopted. That is, a phosphor coating liquid in which a phosphor, a thickener, and a binder are dispersed in a solvent is prepared, and then is applied on the protective film 3 and dried. The thickness of the phosphor layer 4 can be controlled through an adjustment of an amount of the phosphor coating liquid to be applied.

As the above-described solvent for the phosphor coating liquid, water, butyl acetate or the like is used. Further, as the above-described phosphor, an europium-activated yttrium oxide phosphor, a cerium-terbium-activated lanthanum phosphate phosphor, an europium-activated strontium halophosphate phosphor, an europium-activated barium magnesium aluminate phosphor, an europium-manganese-activated barium magnesium aluminate phosphor, a terbium-activated cerium aluminate phosphor, a terbium-activated cerium magnesium aluminate phosphor, an antimony-activated calcium halophosphate phosphor and the like can be used alone or in combination.

The above-described thickener is used to enhance an adhesion property of the phosphor coating liquid, and preferred examples of the thickener include polyethylene oxide, ethylcellulose, nitrocellulose, hydroxylpropylcellulose, hydroxymethylpropylcellulose, carboxymethylcellulose, and polyvinyl alcohol, and most preferred among these is polyethylene oxide for the following reason. That is, polyethylene oxide has high flammability and thus can be removed easily at the time of firing a phosphor. It is preferable that the thickener is used in an amount of 1 g to 50 g per kg of a phosphor. This is because, with this range of an amount of the thickener, the homogeneity of a coating film of a phosphor is increased further.

The above-described binder is used to bind phosphor particles to each other so as to increase the strength of a phosphor layer, and examples of the binder that can be used include aluminum oxide, silicon dioxide, titanium oxide, and zinc oxide, and particularly preferred among these is aluminum oxide for the following reason. That is, aluminum oxide has a large binding force. It is preferable that particles of the binder have a mean particle diameter of 0.01 to 2 μm. This is because, with this range of a mean particle diameter of the particles of the binder, the binder is dispersed uniformly between phosphor particles and thus can provide secure binding between the phosphor particles. Further, it is preferable that the binder is used in an amount of 5 g to 60 g per kg of the above-described phosphor. This is because, with this range of an amount of the binder, the binder can exhibit a sufficient binding force.

There is no particular limitation on the shape, size, or wattage of the fluorescent lamp of this embodiment, and on the color, color rendering property or the like of light emitted by the fluorescent lamp. The shape of the fluorescent lamp is not limited to a straight tube as in this embodiment. Examples of the shape that can be adopted include a circular shape, a double annular shape, a twin shape, a compact shape, a U-shape, and an electric bulb shape, and further include a narrow tube for a liquid crystal backlight and the like. Examples of the size include 4-type to 110-type. Examples of the wattage include several watts to one hundred and several tens of watts. Examples of the light color include daylight color, daylight white color, white color, warm white color, and electric bulb color.

EMBODIMENT 2

The description is directed next to an embodiment of the method of manufacturing a fluorescent lamp according to the present invention. In this embodiment, however, inorganic particles and a glass tube of the same types as described in Embodiment 1 can be used, and thus duplicate descriptions thereof are omitted.

An example of the first method of manufacturing a fluorescent lamp according to the present invention includes process steps of: preparing a protective film liquid by dispersing inorganic particles having a mean particle diameter of 20 nm to 200 nm in water that has been adjusted to have a pH varying by 3 or more from an isoelectric point of the inorganic particles; applying the protective film liquid to an inner face of a glass tube; and drying the protective film liquid applied to the glass tube so that a protective film is formed on a surface of the glass tube.

The protective film liquid is controlled so as to have a pH in a specific range, and the inorganic particles in the protective film liquid are controlled so as to have a mean particle diameter of 20 nm to 200 nm, and thus the volume ratio of the protective film can be controlled so as to be 0.1 to 0.5.

To be more specific, for example, in the case of using aluminum oxide (alumina) having a mean particle diameter of 20 to 200 nm and an isoelectric point of 7.4 to 8.6 as inorganic particles, the pH of a protective film liquid is adjusted to 4 to 5.5, and thus a protective film having a volume ratio of 0.1 to 0.5 can be obtained. Further, in the case of using silicon dioxide (silica) having a mean particle diameter of 20 to 200 nm and an isoelectric point of 1.8 to 2.5 as inorganic particles, the pH of a protective film liquid is adjusted to 8 to 10, and thus a protective film having a volume ratio of 0.1 to 0.5 can be obtained. This can be achieved because the volume ratio of a protective film is conceived to be related to dispersibility of inorganic particles in a protective film liquid such that the dispersibility increases with decreasing volume ratio. Although the relationship between the pH of a protective film liquid and dispersibility of inorganic particles having a specific particle diameter is not clear, it is conceived to be related to a zeta potential of the inorganic particles. Herein, a zeta potential refers to an interface potential generated at an interface between different phases and often is used for the analysis of stability of a fine particle-dispersed system. It has been found that a zeta potential varies depending on an isoelectric point of particles and the pH of a particle liquid. That is, conceivably, the smaller the difference between an isoelectric point of particles and the pH of a particle liquid, the smaller a zeta potential of the particles, and conversely, the larger the difference between an isoelectric point of particles and the pH of a particle liquid, the larger a zeta potential of the particles.

In other words, conceivably, with respect to a protective film liquid containing alumina particles (isoelectric point: 7.4 to 8.6) having a mean particle diameter of 20 to 200 nm, the pH of the protective film liquid is adjusted to 4 to 5.5, and thus a zeta potential of the alumina particles is increased, so that the alumina particles have increased electrostatic repulsion and thus can remain in a highly dispersed state. Further, conceivably, for example, with respect to a protective film liquid containing silica particles (isoelectric point: 1.8 to 2.5) having a mean particle diameter of 20 to 200 nm, the pH of the protective film liquid is adjusted to 8 to 10, and thus a zeta potential of the silica particles is increased, so that the silica particles have increased electrostatic repulsion and thus can remain in a highly dispersed state.

On the other hand, in the case of a protective film liquid according to the conventional technique whose pH is not controlled in the above-described manner, conceivably, a zeta potential of inorganic particles is relatively low compared with a protective film liquid whose pH has been controlled, so that the inorganic particles have decreased electrostatic repulsion and thus flocculate to decrease the dispersibility of the protective film liquid, resulting in the difficulty in obtaining a protective film having a volume ratio of not more than 0.5.

Also in this embodiment, as described above, the thickness of a protective film can be controlled through an adjustment of the amount of a protective film liquid to be applied, and there is no particular limitation on methods of applying the protective film liquid and drying it.

As the above-described inorganic particles, aluminum oxide ($Al_2O_3$), silicon dioxide ($SiO_2$), magnesium oxide (MgO), zinc oxide (ZnO), titanium oxide ($TiO_2$), cerium oxide ($CeO_2$), yttrium oxide ($Y_2O_3$), and calcium halophosphate can be used as described above. Among these, MgO and ZnO are soluble in acid or alkali, and $CeO_2$ and $Y_2O_3$ are soluble in acid. Therefore, in the case where a protective film liquid is adjusted to have a pH in a pH region at which dissolution of inorganic particles of any of these types occurs, in order to suppress the dissolution, deterioration and the like of the inorganic particles, the process steps from the step of preparing the protective film liquid to the step of forming a protective film need to be performed in a short time.

Furthermore, an example of the second method of manufacturing a fluorescent lamp according to the present invention includes process steps of: preparing a protective film liquid by dispersing inorganic particles having a mean particle diameter of 20 nm to 200 nm in an organic solvent containing an organic filler; applying the protective film liquid to an inner face of a glass tube; drying the protective film liquid applied to the glass tube so that a protective film is formed on a surface of the glass tube; and removing the organic filler by heating the protective film.

The protective film liquid is used in which inorganic particles having a mean particle diameter of 20 nm to 200 nm are dispersed in an organic solvent containing an organic filler, and thus the volume ratio of the protective film can be controlled so as to be 0.1 to 0.5. Conceivably, this is because, with the protective film liquid containing an organic filler, the organic filler is dispersed around inorganic particles to suppress the flocculation of the inorganic particles with each other, thereby allowing the inorganic particles to remain in a highly dispersed state. That is, when the protective film liquid containing inorganic particles and an organic filler is applied to a glass tube, in a protective film formed on a surface of the glass tube, the inorganic particles and the organic filler exist in a mixed state. Later, the organic filler is, for example, burned or decomposed by heating so as to be removed, thereby allowing the protective film to have a volume ratio of 0.1 to 0.5.

The above-described organic solvent is not particularly limited and can be, for example, butyl acetate, xylene, butanol, isopropyl alcohol or the like.

Furthermore, the above-described organic filler is not particularly limited as long as it is insoluble in the above-described organic solvent and can be removed at a temperature of about 500° C., and can be, for example, ethylcellulose, nitrocellulose or the like.

The content of the above-described organic filler can be set to 1 wt % to 10 wt % with respect to a total weight of the organic solvent and the organic filler.

Although there is no particular limitation on a method of removing the organic filler by heating the protective film, generally, the organic filler is removed when the protective film and a phosphor layer are heated to be baked onto the glass tube.

In the second method of manufacturing a fluorescent lamp according to the present invention, dissolution of inorganic particles in a protective film liquid does not occur, and thus this method is particularly useful in the case where a protective film is formed using inorganic particles of any of the above-described types that are soluble in acid and/or alkali.

Furthermore, also in the above-described first method of manufacturing a fluorescent lamp according to the present invention, an organic filler further can be added to the protective film liquid in which water is used as a dispersion medium. This allows the volume ratio of a protective film to be decreased further. Examples of the organic filler used in the protective film liquid in which water is used as a dispersion medium include polyethylene oxide, hydroxypropylcellulose, hydroxymethylpropylcellulose, carboxymethylcellulose, and polyvinyl alcohol. Further, in this case, the content of the organic filler could be set to 1 to 3 wt % with respect to a total weight of water and the organic filler.

EMBODIMENT 3

Figure 2:
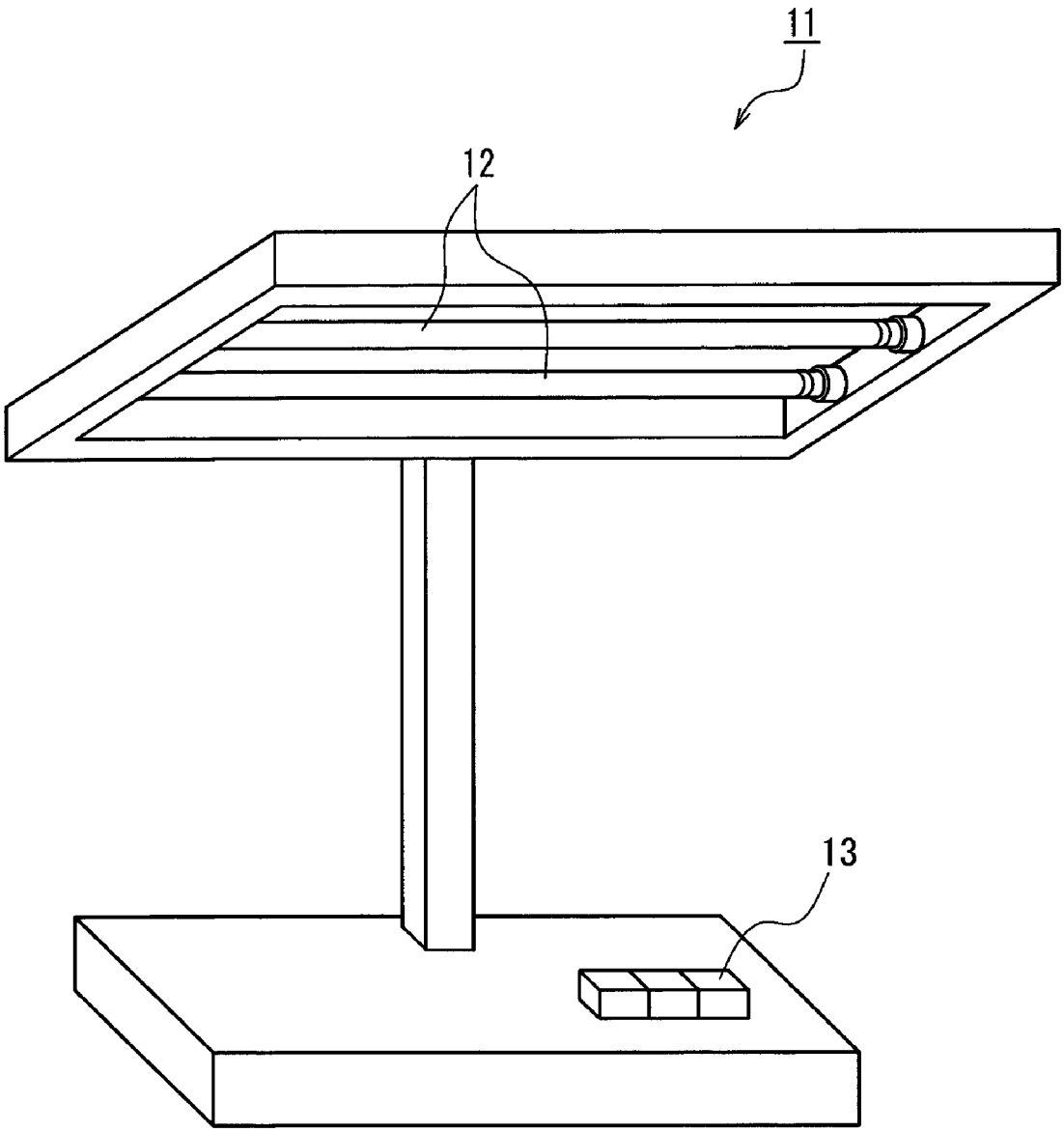
FIG. 2 is a perspective view of a table lamp type illuminator showing an example of an illuminator according to the present invention.

The description is directed next to an embodiment of the illuminator according to the present invention by referring to the appended drawings. FIG. 2 is a perspective view of a table lamp type illuminator showing an example of the illuminator according to the present invention. In FIG. 2, a table lamp type illuminator 11 includes two fluorescent lamps 12 as described in Embodiment 1, and on/off control and light amount control can be performed by a switch 13.

The illuminator of this embodiment uses the fluorescent lamp of Embodiment 1 and thus allows an illuminator to be provided that achieves improvements in luminous flux maintenance factor and in luminous flux.

The following describes the present invention by way of examples.

EXAMPLE 1

<Preparation of Protective Film Liquid>

In 260 g of an acetic acid aqueous solution that has been adjusted to have a pH of 5, 60 g of particles of aluminum oxide (alumina) having a mean particle diameter of 70 nm and an isoelectric point of 8.5 were added and stirred with a stirrer, and thus a protective film liquid was prepared. The mean particle diameter of alumina was measured by the ultrasonic attenuation spectroscopy using the prepared protective film liquid, and a measurement value thus obtained is a value of a mean particle diameter of inorganic particles in a state of being dispersed in the protective film liquid. Specifically, the mean particle diameter of alumina was measured using a particle size distribution measuring apparatus "APS-100" manufactured by Matec Applied Sciences. Also in each of the examples besides this example and the comparative examples, the mean particle diameter of inorganic particles such as of alumina was measured in the same manner as in this example.

<Preparation of Phosphor Coating Liquid>

First, the following materials were prepared as materials for a phosphor coating liquid.

(1) Solvent: 1,700 g of distilled water (2) Phosphor: 350 g of an europium-activated yttrium oxide phosphor ($Y_2O_3$: $Eu^{3+}$, hereinafter, referred to as "YOX") as a red phosphor, 350 g of a cerium-terbium-activated strontium phosphate phosphor ($LaPO_4$: $Ce^{3+}$, $Tb^{3+}$, hereinafter, referred to as "LAP") as a green phosphor, and 300 g of an europium-activated barium magnesium aluminate phosphor ($(Sr, Ca, Ba)_{10}(PO_4)_6Cl_2$: $Eu^{2+}$, hereinafter, referred to as "SCA") as a blue phosphor (3) Thickener: 15 g of polyethylene oxide having a weight-average molecular weight of about 1,000,000

(4) Binder: 15 g of alumina having a mean particle diameter of 50 nm

Next, by the use of a stirrer, polyethylene oxide was dissolved in distilled water to which the phosphors and alumina then were added in this order and stirred, and thus a phosphor coating liquid was prepared.

<Manufacture of Straight Tube Fluorescent Lamp>

Using the above-described protective film liquid and phosphor coating liquid, a 20 W straight tube type fluorescent lamp was manufactured in the following manner. First, from an upper portion of a straight glass tube that was made of soda-lime glass and placed so that its longitudinal direction coincides with a vertical direction, the above-described protective film liquid was poured and allowed to flow down spontaneously so as to adhere to the inside of the glass tube. After that, with respect to the protective film liquid that was allowed to adhere, drying was performed using warm air at a temperature of about 60° C. for 4 minutes, and thus a protective film was formed on an inner face of the glass tube.

Next, from the upper portion of the glass tube in which the protective film was formed, the above-described phosphor coating liquid was poured and allowed to flow down spontaneously so as to adhere onto the protective film. After that, with respect to the phosphor coating liquid that was allowed to adhere, drying was performed using warm air at a temperature of about 60° C. for about 10 minutes, and thus a phosphor layer was laminated on the protective film. After that, the glass tube as a whole was put in a gas furnace and heated in the air at a temperature of about 550° C. for about 3 minutes so that the protective film and the phosphor layer were baked to be fixed to the glass tube. The design thicknesses of the protective film and the phosphor layer were set to 2 μm and 20 μm, respectively. Subsequently, glass having an exhaust pipe, to which an electrode was mounted, was fused to each end portion of the glass tube, and the glass tube was evacuated of air through the exhaust pipe using a rotary pump. Finally, mercury and an argon gas were enclosed and a base was attached, and thus the fluorescent lamp was manufactured.

EXAMPLE 2

<Preparation of Protective Film Liquid>

In 300 g of an ammonia aqueous solution that has been adjusted to have a pH of 8, 60 g of particles of silicon dioxide (silica) having a mean particle diameter of 70 nm and an isoelectric point of 2 were added and stirred with a stirrer, and thus a protective film liquid was prepared.

<Preparation of Phosphor Coating Liquid>

First, the following materials were prepared as materials for a phosphor coating liquid.

(1) Solvent: 400 g of butyl acetate (2) Phosphor: 350 g of YOX as a red phosphor, 350 g of LAP as a green phosphor, and 300 g of europium-activated strontium halophosphate ($BaMgAl_{10}O_{17}$: $Eu^{2+}$, hereinafter, referred to as "BAM") as a blue phosphor (3) Thickener: 40 g of ethylcellulose (4) Binder: 30 g of mixed ceramic (having a particle diameter of 0.5 to 1 μm) of 60 mass % of $CaO_{0.7}BaO_{1.6}B_2O_3$ and 40 mass % of $CaP_2O_7$ Next, by the use of a stirrer, butyl acetate was dissolved in ethylcellulose to which the phosphors and the mixed ceramic then were added in this order and stirred, and thus a phosphor coating liquid was prepared.

<Manufacture of Circular Tube Fluorescent Lamp>

Using the above-described protective film liquid and phosphor coating liquid, a 30 W circular tube type fluorescent lamp was manufactured in the following manner. First, from an upper portion of a straight glass tube that was made of soda-lime glass and placed so that its longitudinal direction coincides with a vertical direction, the above-described protective film liquid was poured and allowed to flow down spontaneously so as to adhere to the inside of the glass tube. After that, with respect to the protective film liquid that was allowed to adhere, drying was performed using warm air at a temperature of about 60° C. for 4 minutes, and thus a protective film was formed on an inner face of the glass tube.

Next, from the upper portion of the glass tube in which the protective film was formed, the above-described phosphor coating liquid was poured and allowed to flow down spontaneously so as to adhere onto the protective film. After that, with respect to the phosphor coating liquid that was allowed to adhere, drying was performed using warm air at a temperature of about 60° C. for about 10 minutes, and thus a phosphor layer was laminated on the protective film. After that, the glass tube as a whole was put in a gas furnace and heated in the air at a temperature of about 550° C. for about 3 minutes so that the protective film and the phosphor layer were baked to be fixed to the glass tube. The design thicknesses of the protective film and the phosphor layer were set to 2 μm and 20 μm, respectively. Subsequently, glass having an exhaust pipe, to which an electrode was mounted, was fused to each end portion of the glass tube, and the glass tube was formed into a loop shape by heating at a temperature of 700° C. Next, the glass tube was evacuated of air from the exhaust pipe using a rotary pump. Finally, mercury and an argon gas were enclosed and a base was attached, and thus the fluorescent lamp was manufactured.

COMPARATIVE EXAMPLE 1

<Preparation of Protective Film Liquid>

In 300 g of distilled water, 30 g of particles of alumina having a mean particle diameter of 70 nm and an isoelectric point of 8.5 were added and stirred with a stirrer, and thus a protective film liquid was prepared.

<Manufacture of Straight Tube Fluorescent Lamp>

A fluorescent lamp was manufactured in the same manner as in the case of Example 1 except that the above-described protective film liquid was used to form a protective film having a design thickness of 0.2 μm.

COMPARATIVE EXAMPLE 2

<Preparation of Protective Film Liquid>

In 300 g of distilled water, 30 g of particles of silica having a mean particle diameter of 80 nm and an isoelectric point of 2 were added and stirred with a stirrer, and thus a protective film liquid was prepared.

<Manufacture of Circular Tube Fluorescent Lamp>

A fluorescent lamp was manufactured in the same manner as in the case of Example 2 except that the above-described protective film liquid was used to form a protective film having a design thickness of 0.2 μm.

<Measurements of Thickness and Volume Ratio of Protective Film>

With respect to each of the fluorescent lamps of Examples 1 and 2 and Comparative Examples 1 and 2, the thickness and volume ratio of the protective film were determined in the following manners, respectively.

The thickness of the protective film was measured using an electron micrograph showing a cross section of the protective film formed on the surface of the glass tube. Specifically, the thickness of the protective film was measured at three points of the glass tube, which are both ends and a center portion thereof, and a mean value of respective measurement values was used as a value of the thickness of the protective film.

Figure 3:
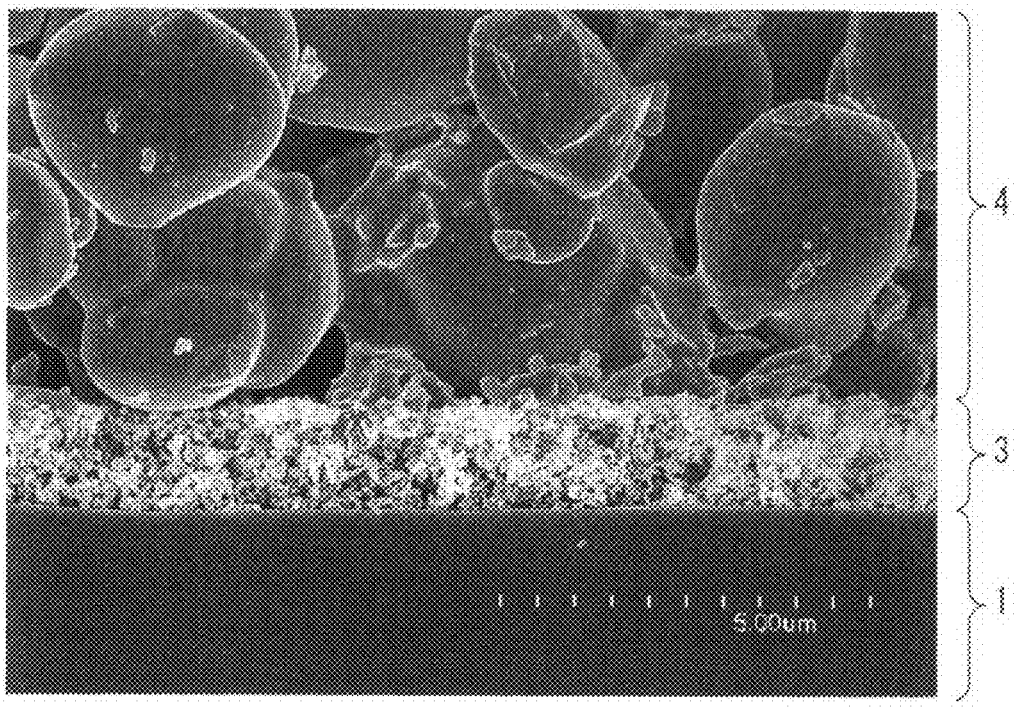
FIG. 3 is an electron micrograph of a protective film used in Example 2.
Figure 4:
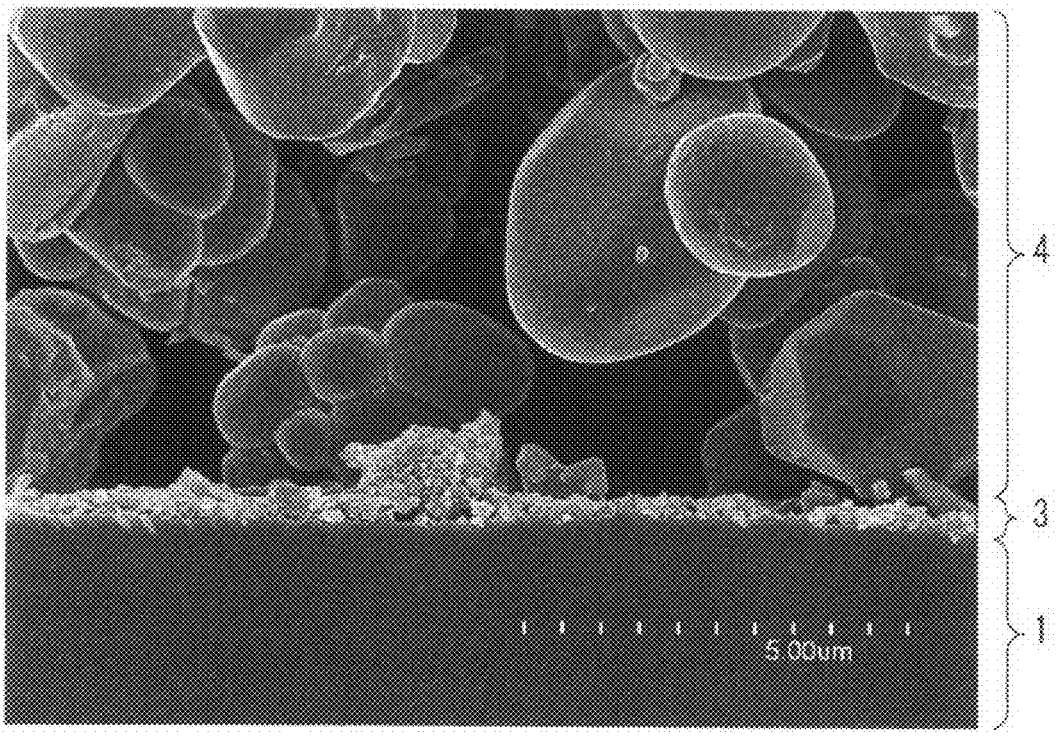
FIG. 4 is an electron micrograph of a protective film used in Comparative Example 2.

For reference, FIG. 3 shows an electron micrograph of the protective film of Example 2, and FIG. 4 shows an electron micrograph of the protective film of Comparative Example 2. It is understood from each of FIGS. 3 and 4 that a protective film 3 is formed between a glass tube 1 and a phosphor layer 4.

Next, using the above-described electron micrographs, a total occupied volume V of the protective film on the surface of the glass tube was determined. Subsequently, after the phosphor layer on the protective film was removed with a brush, the protective film was peeled off of the glass tube with a spatula, and a total mass M of protective film particles thus peeled off was measured. Moreover, by the use of a Tsutsui air/helium type particle density measuring apparatus manufactured by Tsutsui Rikagaku Kikai Co., Ltd, a particle density D of the protective film particles was measured by the constant volume compression method. Based on these measurement values, a value calculated from M/(V×D) was used as a value of the volume ratio of the protective film.

<Measurement of Total Luminous Flux of Fluorescent Lamp>

Using each of the fluorescent lamps of Examples 1 and 2 and Comparative Examples 1 and 2, a total luminous flux after 100 hours of lighting was measured using an integrating sphere.

The results are shown in Table 1.

TABLE 1

| | Thickness of protective film (μm) | Volume ratio of protective film | Total luminous flux (lm) |
|---|---|---|---|
| Example 1 | 2.2 | 0.32 | 1379 |
| Example 2 | 2.1 | 0.28 | 2078 |
| Comparative Ex. 1 | 0.19 | 0.62 | 1349 |
| Comparative Ex. 2 | 0.23 | 0.58 | 2018 |

It is understood from Table 1 that, as for a straight tube fluorescent lamp, Example 1 exhibited a total luminous flux improved by about 2% compared with that in the case of Comparative Example 1, and as for a circular tube fluorescent lamp, Example 2 exhibited a total luminous flux improved by about 3% compared with that in the case of Comparative Example 2.

<Measurement of Luminous Flux Maintenance Factor of Fluorescent Lamp>

Figure 5:
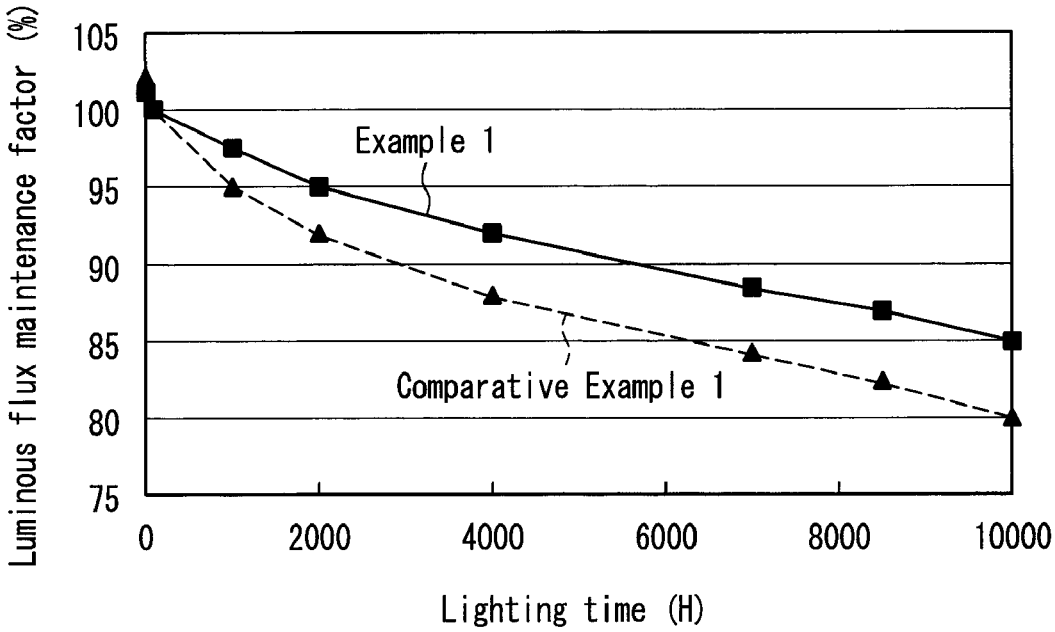
FIG. 5 is a diagram showing a relationship between a luminous flux maintenance factor and a lighting time in each of the cases of Example 1 and Comparative Example 1.
Figure 6:
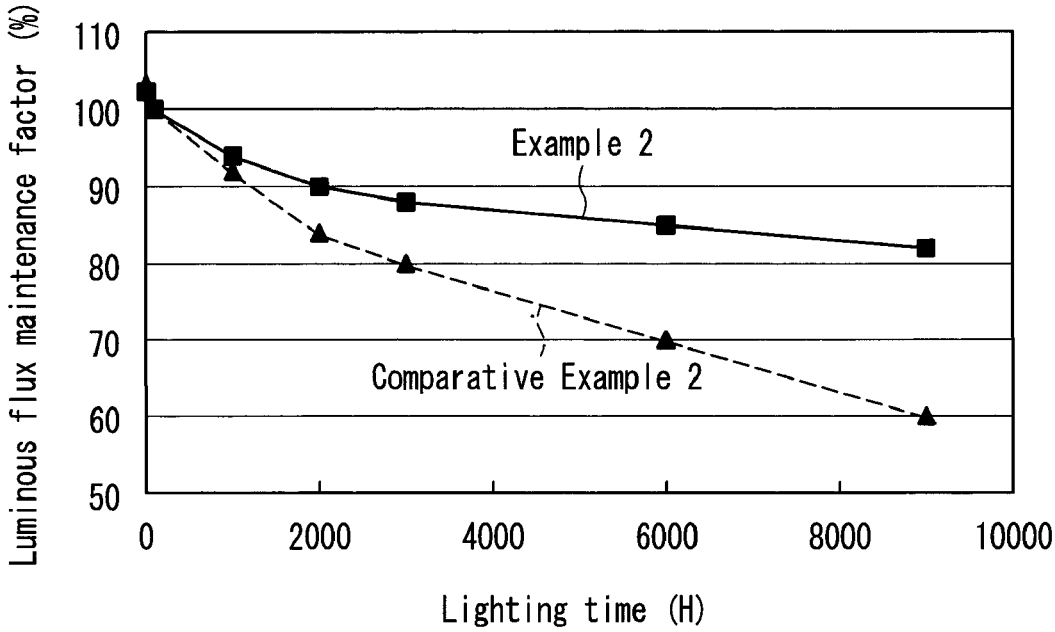
FIG. 6 is a diagram showing a relationship between a luminous flux maintenance factor and a lighting time in each of the cases of Example 2 and Comparative Example 2.

Each of the fluorescent lamps whose total luminous flux was measured as described above was lit continuously, and a luminous flux maintenance factor after each given time period of lighting was determined. The luminous flux maintenance factor was defined as a value (%) expressed by (B/A)×100 where a total luminous flux of a fluorescent lamp after 100 hours of lighting was indicated as A (lm), and a total luminous flux of the fluorescent lamp after a specific time period of lighting thereafter was indicated as B (lm). The results are shown in FIGS. 5 and 6. FIG. 5 shows that, as for a straight tube fluorescent lamp, a luminous flux maintenance factor after 10,000 hours of lighting was 85% in the case of Example 1, while the factor was 80% in the case of Comparative Example 1. Further, FIG. 6 shows that, as for a circular tube fluorescent lamp, a luminous flux maintenance factor after 9,000 hours of lighting was maintained at 80% or higher in the case of Example 2, while the factor was decreased to 60% in the case of Comparative Example 2.

<Optimization of Volume Ratio of Protective Film>

Next, an attempt was made to optimize the volume ratio of a protective film. First, using the same materials as those used in Example 1, straight tube fluorescent lamps were manufactured so as to vary the thickness and volume ratio of a protective film, and peeling of the protective films was observed visually. The results are shown in Table 2. In Table 2, a fluorescent lamp in which no peeling of the protective film was observed is indicated by "A", a fluorescent lamp in which film peeling in a size of 5 mm square or larger was observed is indicated by "C", and a fluorescent lamp in which film peeling in a size smaller than 5 mm square was observed is indicated by "B".

TABLE 2

| Thickness | Volume ratio of protective film | | | | | | | |
|---|---|---|---|---|---|---|---|---|
| (μm) | 0.1 | 0.2 | 0.3 | 0.4 | 0.5 | 0.6 | 0.7 | 0.8 |
| 0.2 | — | — | — | — | — | A | A | A |
| 0.5 | A | A | A | A | A | B | B | B |
| 1 | A | A | A | A | A | C | C | C |
| 2 | A | A | A | A | A | — | — | — |
| 3 | A | A | A | A | A | — | — | — |
| 4 | C | C | C | C | C | — | — | — |

Table 2 shows that no peeling of the protective film was observed in each of the cases of the protective films having a thickness in the range of 0.5 to 3 μm and a volume ratio in the range of 0.1 to 0.5. Moreover, the fluorescent lamps including these protective films in each of which no peeling of the protective film was observed were lit for up to 10,000 hours, and their luminous flux maintenance factors were measured. The results of the measurement show that a luminous flux maintenance factor of 85% or higher could be maintained in each of the cases of the protective films having a thickness in the range of 1 to 2 μm and a volume ratio in the range of 0.2 to 0.4.

On the other hand, in each of the cases of the protective films having a volume ratio of less than 0.1, the film strength was too small, thus hampering the formation of the protective film. Further, in each of the cases of the protective films having a thickness of 4 μm, even when the volume ratio was set to not more than 0.5, film peeling occurred.

In Table 2, the values of the volume ratio and the thickness values 0.2 μm and 0.5 μm of the protective films were obtained by rounding to one decimal place, respectively, and the thickness values 1 to 4 μm of the protective films were obtained by rounding to zero decimal places, respectively. The same holds true with Table 3 below.

Next, using the same materials as those used in Example 2, circular tube fluorescent lamps were manufactured so as to vary in thickness and volume ratio of a protective film, and peeling of the protective films was observed visually. The results are shown in Table 3. In Table 3, a fluorescent lamp in which no peeling of the protective film was observed is indicated by "A", and a fluorescent lamp in which film peeling in a size of 5 mm square or larger was observed is indicated by "C".

TABLE 3

| Thickness | Volume ratio of protective film | | | | | | | |
|---|---|---|---|---|---|---|---|---|
| (μm) | 0.1 | 0.2 | 0.3 | 0.4 | 0.5 | 0.6 | 0.7 | 0.8 |
| 0.2 | — | — | — | — | — | A | A | A |
| 0.5 | A | A | A | A | A | C | C | C |
| 1 | A | A | A | A | A | — | — | — |
| 2 | A | A | A | A | A | — | — | — |
| 3 | A | A | A | A | A | — | — | — |
| 4 | C | C | C | C | C | — | — | — |

Table 3 shows that no peeling of the protective film was observed in each of the cases of the protective films having a thickness in the range of 0.5 to 3 μm and a volume ratio in the range of 0.1 to 0.5. Moreover, the fluorescent lamps including these protective films in each of which no peeling of the protective film was observed were lit for up to 9,000 hours, and their luminous flux maintenance factors were measured. The results of the measurement show that a luminous flux maintenance factor of 80% or higher could be maintained in each of the cases of the protective films having a thickness in the range of 1 to 2 μm and a volume ratio of 0.2 to 0.4.

On the other hand, in each of the cases of the protective films having a volume ratio of less than 0.1, the film strength was too small, thus hampering the formation of the protective film. Further, in each of the cases of the protective films having a thickness of 4 μm, even when the volume ratio was set to not more than 0.5, film peeling occurred.

EXAMPLE 3

In 300 $cm^3$ of a butyl acetate solution containing 5 wt % of ethylcellulose (organic filler), 40 g of particles of zinc oxide (ZnO) having a mean particle diameter of 20 nm were added and stirred with a stirrer, and thus a protective film liquid was prepared. A fluorescent lamp was manufactured in the same manner as in the case of Example 1 except that this protective film liquid was used to form a protective film having a design thickness of 2 μm.

EXAMPLE 4

In 260 g of an ammonia aqueous solution that has been adjusted to have a pH of 9, 60 g of particles of titanium oxide ($TiO_2$) having a mean particle diameter of 50 nm and an isoelectric point of 6 were added and stirred with a stirrer, and thus a protective film liquid was prepared. A fluorescent lamp was manufactured in the same manner as in the case of Example 1 except that this protective film liquid was used to form a protective film having a design thickness of 2 μm.

EXAMPLE 5

In 260 g of an acetic acid aqueous solution that has been adjusted to have a pH of 5, 50 g of particles of magnesium oxide (MgO) having a mean particle diameter of 100 nm and an isoelectric point of 12 were added and stirred with a stirrer, and thus a protective film liquid was prepared. A fluorescent lamp was manufactured in the same manner as in the case of Example 1 except that this protective film liquid was used to form a protective film having a design thickness of 2 μm.

EXAMPLE 6

In 300 g of an acetic acid aqueous solution that has been adjusted to have a pH of 4, 110 g of particles of cerium oxide ($CeO_2$) having a mean particle diameter of 50 nm and an isoelectric point of 7 were added and stirred with a stirrer, and thus a protective film liquid was prepared. A fluorescent lamp was manufactured in the same manner as in the case of Example 1 except that this protective film liquid was used to form a protective film having a design thickness of 2 μm.

EXAMPLE 7

In 300 g of acetic acid aqueous solution that has been adjusted to have a pH of 5, 70 g of particles of yttrium oxide ($Y_2O_3$) having a mean particle diameter of 150 nm and an isoelectric point of 9.3 were added and stirred with a stirrer, and thus a protective film liquid was prepared. A fluorescent lamp was manufactured in the same manner as in the case of Example 1 except that this protective film liquid was used to form a protective film having a design thickness of 2 μm.

COMPARATIVE EXAMPLE 3

In 300 $cm^3$ of a butyl acetate solution, 20 g of particles of zinc oxide (ZnO) having a mean particle diameter of 20 nm were added and stirred with a stirrer, and thus a protective film liquid was prepared. A fluorescent lamp was manufactured in the same manner as in the case of Example 1 except that this protective film liquid was used to form a protective film having a design thickness of 0.2 μm.

COMPARATIVE EXAMPLE 4

In 300 g of distilled water, 20 g of particles of titanium oxide ($TiO_2$) having a mean particle diameter of 50 nm and an isoelectric point of 6 were added and stirred with a stirrer, and thus a protective film liquid was prepared. A fluorescent lamp was manufactured in the same manner as in the case of Example 1 except that this protective film liquid was used to form a protective film having a design thickness of 0.2 μm.

COMPARATIVE EXAMPLE 5

In 300 g of distilled water, 15 g of particles of magnesium oxide (MgO) having a mean particle diameter of 100 nm and an isoelectric point of 12 were added and stirred with a stirrer, and thus a protective film liquid was prepared. A fluorescent lamp was manufactured in the same manner as in the case of Example 1 except that this protective film liquid was used to form a protective film having a design thickness of 0.2 μm.

COMPARATIVE EXAMPLE 6

In 300 g of distilled water, 50 g of particles of cerium oxide ($CeO_2$) having a mean particle diameter of 50 nm and an isoelectric point of 7 were added and stirred with a stirrer, and thus a protective film liquid was prepared. A fluorescent lamp was manufactured in the same manner as in the case of Example 1 except that this protective film liquid was used to form a protective film having a design thickness of 0.2 μm.

COMPARATIVE EXAMPLE 7

In 300 g of distilled water, 20 g of particles of yttrium oxide ($Y_2O_3$) having a mean particle diameter of 150 nm and an isoelectric point of 9.3 were added and stirred with a stirrer, and thus a protective film liquid was prepared. A fluorescent lamp was manufactured in the same manner as in the case of Example 1 except that this protective film liquid was used to form a protective film having a design thickness of 0.2 μm.

<Measurements of Thickness and Volume Ratio of Protective Film>

With respect to each of the fluorescent lamps of Examples 3 to 7 and Comparative Examples 3 to 7, the thickness and volume ratio of the protective film were determined in the same manner as in the case of Example 1.

<Measurement of Total Luminous Flux of Fluorescent Lamp>

By the use of each of the fluorescent lamps of Examples 3 to 7 and Comparative Examples 3 to 7, a total luminous flux after 100 hours of lighting was measured using an integrating sphere.

<Measurement of Luminous Flux Maintenance Factor of Fluorescent Lamp>

Using each of the fluorescent lamps of Examples 3 to 7 and Comparative Examples 3 to 7 whose total luminous flux was measured as described above, a luminous flux maintenance factor after each given time period of lighting was determined in the same manner as in the case of Example 1.

The results of the above-described determination are shown in Table 4. Table 4 shows luminous flux maintenance factors obtained after 10,000 hours of lighting.

TABLE 4

| | Thickness of protective film (μm) | Volume ratio of protective film | Total luminous flux (lm) | Luminous flux maintenance factor (%) |
|---|---|---|---|---|
| Example 3 | 2.9 | 0.35 | 1,362 | 80 |
| Example 4 | 2.6 | 0.45 | 1,340 | 80 |
| Example 5 | 1.3 | 0.48 | 1,375 | 88 |
| Example 6 | 1.3 | 0.36 | 1,365 | 78 |
| Example 7 | 2.5 | 0.42 | 1,360 | 82 |
| Comparative Ex. 3 | 0.3 | 0.62 | 1,325 | 70 |
| Comparative Ex. 4 | 0.5 | 0.62 | 1,305 | 63 |
| Comparative Ex. 5 | 0.15 | 0.57 | 1,338 | 81 |
| Comparative Ex. 6 | 0.15 | 0.5 | 1,328 | 60 |
| Comparative Ex. 7 | 0.5 | 0.53 | 1,326 | 75 |

As is understood from Table 4, a comparison between an example and a comparative example that use inorganic particles of the same type reveals that, in each of the cases of Examples 3 to 7, a total luminous flux was improved by about 2% compared with those in the cases of Comparative Examples 3 to 7. Further, the same comparison reveals that, in each of the cases of Examples 3 to 7, a luminous flux maintenance factor also was improved compared with those in the cases of Comparative Examples 3 to 7.

EXAMPLE 8

In 300 $cm^3$ of a butyl acetate solution containing wt % of ethylcellulose (organic filler), 20 g of particles of zinc oxide (ZnO) having a mean particle diameter of 20 nm and 40 g of particles of aluminum oxide (alumina) having a mean particle diameter of 70 nm were added and stirred with a stirrer, and thus a protective film liquid was prepared. A fluorescent lamp was manufactured in the same manner as in the case of Example 1 except that this protective film liquid was used to form a protective film having a design thickness of 3 μm.

<Measurements of Thickness and Volume Ratio of Protective Film>

With respect to the fluorescent lamp of Example 8, the thickness and volume ratio of the protective film were determined in the same manner as in the case of Example 1, and a volume ratio of 0.5 and a thickness of 2.8 μm were obtained as results of the determination.

<Measurement of Total Luminous Flux of Fluorescent Lamp>

By the use of the fluorescent lamp of Example 8, a total luminous flux after 100 hours of lighting was measured using an integrating sphere. A value of 1,370 (lm) was obtained as a result thereof. This value was substantially an intermediate value between a total luminous flux of 1,379 (lm) obtained in the case of Example 1 using alumina alone and a total luminous flux of 1,362 (lm) obtained in the case of Example 3 using zinc oxide alone. Conceivably, this is because zinc oxide has a refractive index of 1.9 that is higher than the refractive index of alumina having a value of 1.7, and thus in this case, the addition of zinc oxide rendered a radiant intensity of extracted visible light (luminous flux) lower than that in the case of using alumina alone.

<Measurement of Emission Spectrum>

Figure 7:
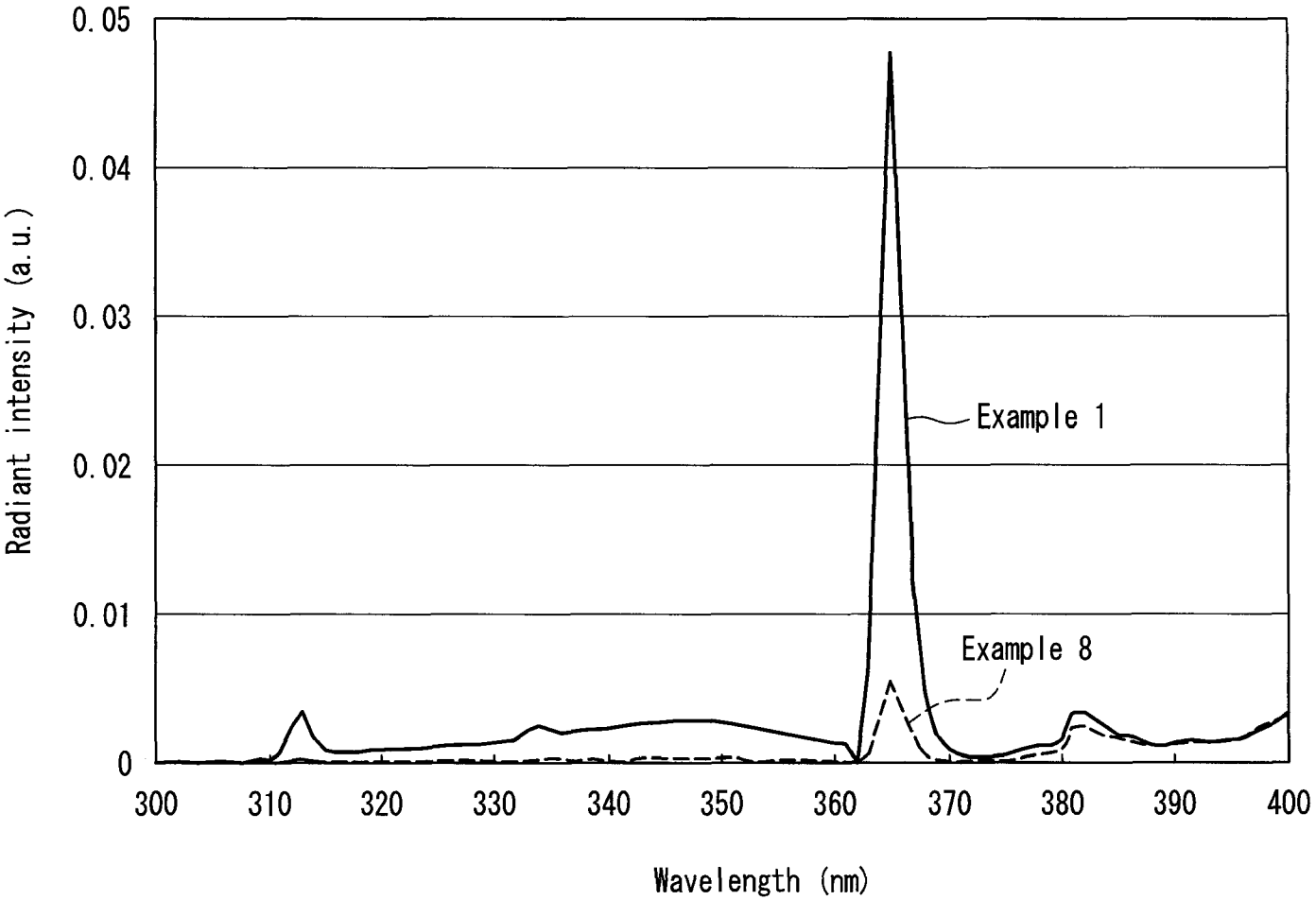
FIG. 7 is a diagram showing an emission spectrum in each of the cases of Example 1 and Example 8.

By the use of each of the fluorescent lamps of Examples 1 and 8, an emission spectrum of light in the ultraviolet region (300 to 400 nm) was measured. The results are shown in FIG. 7. It is understood from FIG. 7 that in the case of Example 8, a peak value of a radiant intensity of near-ultraviolet light in the near-ultraviolet region could be reduced to about one tenth that in the case of Example 1. This is because zinc oxide has high cutoff performance with respect to near-ultraviolet light compared with that of alumina.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

INDUSTRIAL APPLICABILITY

As described in the foregoing discussion, the present invention can provide a fluorescent lamp that achieves improvements in luminous flux maintenance factor and in luminous flux, a method of manufacturing the fluorescent lamp, and an illuminator using the fluorescent lamp, and thus is of industrial significance.

The invention claimed is:

1. A fluorescent lamp, comprising:

a glass tube in which mercury and a rare gas are enclosed;

a protective film that is attached so as to cover an inner face of the glass tube; and a phosphor layer that is laminated on the protective film, wherein the protective film has a thickness of 0.5 μm to 3 μm, the protective film is formed of inorganic particles, and has a volume ratio of 0.1 to 0.5, and the inorganic particles consist of at least one selected from a group consisting of silicon dioxide, magnesium oxide, zinc oxide, titanium oxide, cerium oxide, yttrium oxide, and calcium halophosphate.

2. The fluorescent lamp according to claim 1, wherein the volume ratio is 0.2 to 0.4.

3. The fluorescent lamp according to claim 1, wherein the thickness of the protective film is 1 μm to 2 μm.

4. The fluorescent lamp according to claim 1, wherein the glass tube is one selected from a straight glass tube and a circular glass tube.

5. A lighting system comprising a fluorescent lamp as claimed in claim 1.

6. A method of manufacturing a fluorescent lamp as claimed in claim 1, comprising process steps of:

preparing a protective film liquid by dispersing inorganic particles having a mean particle diameter of 20 nm to 200 nm in water that has been adjusted to have a pH varying by 3 or more from an isoelectric point of the inorganic particles;

applying the protective film liquid to an inner face of a glass tube; and drying the protective film liquid applied to the glass tube so that a protective film is formed on a surface of the glass tube.

7. The method according to claim 6, wherein in a case of using aluminum oxide particles as the inorganic particles, the pH is 4 to 5.5.

8. The method according to claim 6, wherein in a case of using silicon dioxide particles as the inorganic particles, the pH is 8 to 10.

9. A method of manufacturing a fluorescent lamp as claimed in claim 1, comprising process steps of:

preparing a protective film liquid by dispersing inorganic particles having a mean particle diameter of 20 nm to 200 nm in an organic solvent containing an organic filler;

applying the protective film liquid to an inner face of a glass tube;

drying the protective film liquid applied to the glass tube so that a protective film is formed on a surface of the glass tube; and removing the organic filler by heating the protective film.

10. The method according to claim 9, wherein a content of the organic filler is 1 wt % to 10 wt % with respect to a total weight of the organic solvent and the organic filler.

11. A fluorescent lamp, comprising:

a glass tube in which mercury and a rare gas are enclosed;

a protective film that is attached so as to cover an inner face of the glass tube; and a phosphor layer that is laminated on the protective film, wherein the protective film has a thickness of 0.5 μm to 3 μm, and the protective film is formed of aluminum oxide particles and has a volume ratio of 0.1 to 0.32.

12. A lighting system comprising a fluorescent lamp as claimed in claim 11.

* * * * *